US009457941B2

(12) United States Patent
Kawakami

(10) Patent No.: US 9,457,941 B2
(45) Date of Patent: Oct. 4, 2016

(54) MULTIPURPOSE ELASTIC LOOP GASKET

(76) Inventor: Tomoya Kawakami, Juneau, AK (US)

( * ) Notice: Subject to any disclaimer, the term of this patent is extended or adjusted under 35 U.S.C. 154(b) by 1796 days.

(21) Appl. No.: 12/699,800

(22) Filed: Feb. 3, 2010

(65) Prior Publication Data

US 2011/0186578 A1 Aug. 4, 2011

(51) Int. Cl.
*B65D 53/00* (2006.01)

(52) U.S. Cl.
CPC ..... *B65D 53/00* (2013.01)

(58) Field of Classification Search
USPC ..... 220/378, 634, 659, 642, 320, 658, 629, 220/699, 700, 701, 656, 657, 648, 630, 319, 220/632, 615
See application file for complete search history.

(56) References Cited

U.S. PATENT DOCUMENTS

| | | | | | |
|---|---|---|---|---|---|
| 2,004,449 | A | | 6/1935 | Stanley | |
| 2,064,411 | A | * | 12/1936 | Brandstein | 215/321 |
| 2,080,108 | A | | 5/1937 | Brandstein | |
| 2,146,190 | A | * | 2/1939 | Luke | 24/482 |
| 2,210,183 | A | * | 8/1940 | Schweighart | 206/557 |
| 2,523,639 | A | * | 9/1950 | Tucker | 220/320 |
| 2,591,482 | A | * | 4/1952 | Weltlich | 220/700 |
| 2,628,739 | A | * | 2/1953 | Vischer, Jr. | 220/305 |
| 2,856,092 | A | * | 10/1958 | Knapp | 220/592.2 |
| 3,355,057 | A | * | 11/1967 | MacKenzie et al. | 220/378 |
| 3,424,340 | A | * | 1/1969 | Rocher | 220/320 |
| 3,713,660 | A | * | 1/1973 | Luthe | 277/644 |
| 3,790,020 | A | * | 2/1974 | Fine | 220/319 |
| 3,834,579 | A | * | 9/1974 | LaCroce | 220/319 |
| 4,091,961 | A | * | 5/1978 | DuBois et al. | 220/319 |
| 4,094,460 | A | * | 6/1978 | Scanga et al. | 229/123.1 |
| 4,182,461 | A | * | 1/1980 | Waldau | 220/320 |
| 4,206,499 | A | * | 6/1980 | Urbanek et al. | 362/546 |
| 4,249,690 | A | * | 2/1981 | Held, Jr. | 229/5.5 |
| 4,305,535 | A | * | 12/1981 | Brundige et al. | 229/5.7 |
| 4,854,476 | A | * | 8/1989 | Serio, Jr. | 220/4.01 |
| 5,048,714 | A | | 9/1991 | Stevens | |
| 5,190,209 | A | * | 3/1993 | Gordon et al. | 229/5.7 |

(Continued)

FOREIGN PATENT DOCUMENTS

| | | |
|---|---|---|
| DE | 3615680 | 11/1987 |
| FR | 1182612 | 1/1959 |

(Continued)

*Primary Examiner* — Fenn Mathew
*Assistant Examiner* — Jennifer Castriotta
(74) *Attorney, Agent, or Firm* — Clyde I. Coughenout

(57) ABSTRACT

An essentially "U" shaped endless elastic loop gasket, with the opening facing inwardly, has multipurpose uses with flanged containers. A foil can be stretched over the top of a raised ridge on top of the multipurpose elastic loop gasket on the flanged containers to form a closure. A foil can alternately be placed over the container flange around the container opening under the elastic loop gasket to form a closure. The elastic loop is stretched to encompass both the foil and flange and then released to secure the foil over the container opening. A first foil can be placed between the elastic loop gasket and container flange and a second foil can be placed over the raised ridge forming an insulation area over the container opening. Heat-resistant elastic loop gaskets of low heat conductivity enable the pan or container to be placed in an oven or refrigerator and removed by bare hands. The elastic loop gasket upper and lower corners extend inward to form webs that rigidify the corners and ease application and removal of the closure from the container flanges. The elastic loop gasket seals the container over a container support and/or the container lid over the container.

14 Claims, 4 Drawing Sheets

(56) References Cited

U.S. PATENT DOCUMENTS

| | | | | |
|---|---|---|---|---|
| 5,662,242 | A * | 9/1997 | Steo | 220/695 |
| 5,690,248 | A * | 11/1997 | Hulls | 220/495.05 |
| 5,697,513 | A * | 12/1997 | Molodyi | 220/320 |
| 5,964,368 | A * | 10/1999 | Schramm | 220/320 |
| 6,019,240 | A * | 2/2000 | Legeza | 220/321 |
| 6,296,336 | B1 * | 10/2001 | Hattori | 312/296 |
| 6,722,520 | B2 * | 4/2004 | Hupp et al. | 220/315 |
| D491,024 | S | 6/2004 | Welsh | |
| 7,621,417 | B2 * | 11/2009 | Peterson et al. | 220/254.3 |
| 7,922,027 | B2 * | 4/2011 | Boyden et al. | 220/573.2 |
| 7,959,161 | B2 * | 6/2011 | Seki et al. | 277/648 |
| 2001/0019060 | A1 * | 9/2001 | Zank | 220/573.1 |
| 2003/0015540 | A1 * | 1/2003 | Liu | 220/642 |
| 2006/0261067 | A1 * | 11/2006 | Letica | 220/254.7 |
| 2011/0049155 | A1 * | 3/2011 | Levine et al. | 220/319 |

FOREIGN PATENT DOCUMENTS

| | | |
|---|---|---|
| GB | 18664 | 0/1912 |
| GB | 973460 | 10/1964 |

* cited by examiner

MULTIPURPOSE ELASTIC LOOP GASKET

The present invention is a modification of prior U.S. Pat. No. 5,964,368, issued Oct. 12, 1999.

BACKGROUND OF THE INVENTION

1. Field of the Invention

A gasket for an outwardly flanged open top container is disclosed. A "U" shaped endless elastic loop gasket having its recess facing inwardly is stretched over the flange of the container to hold a foil or wrap in place over the open top of the container and/or seal a lid over the container and/or seal the container to a steam chest.

2. Description of the Related Art

The use of removable closures has been common for centuries. This use includes resilient loop means holding foil covers over access openings, such as a paper or plastic held by an elastic band. The U.S. patents issued to S. J. Brandstein, U.S. Pat. No. 2,064,411, issued 15 Dec. 1936 and U.S. Pat. No. 2,080,108, issued 11 May 1937; the U.S. Patent to J. W. Luke, U.S. Pat. No. 2,146,190, issued 7 Feb. 1939; and German DE 3,615,680 A1 of 12 Nov. 1987 to W. Kunzel are examples of resiliently held covers on containers. The patent to G. S. Stanley, U.S. Pat. No. 2,004,449, issued 11 Jun. 1935; British Patent No. 973,460 of 28 Oct. 1964 to J. K. M. Cooke; and British Patent A.D. 1911, No. 18,664 of 11 Jul. 1912 to H. H. Denman et al are examples of flanged containers provided with closure means including resilient inwardly facing "U" shaped securing means. The French patent, 1,182,612, issued to Illinois Tool Works, Delivered 19 Jan. 1959, teaches an indented retainer used over the bead of a shaped cover. A typical container is shown by J. Stevens in U.S. Pat. No. 5,048,714, issued Sep. 17, 1991; and Hupp et al, U.S. Pat. No. 6,722,520, issued Apr. 20, 2004, show an inwardly facing slider used to open and close a container. A circular container with a tabbed lid is shown by T. Welsh in U.S. D491024 of Jun. 8, 2004.

SUMMARY OF THE INVENTION

The present invention provides a multipurpose elastic loop gasket for a container having an access opening with a flange extending outwardly around the opening. An endless elastic loop, having an essentially "U" shape, has its recess or opening facing inwardly. The elastic loop gasket can act as a seal between a container and a steam chest and/or seal a container lid to a container and/or hold foils over the container opening. The bottom leg of the elastic loop gasket can be provided with a bead on its inner surface to press a foil against the bottom of the container flange or seal the gasket to the container flange. The upper leg of the elastic loop gasket is provided with an integrally molded protrusion or raised ridge to interact with a foil and/or seal a lid over the container. The protrusion can cooperate to clamp a second foil between the protrusion and container lid while a first foil is stretched over the container flange under the upper leg of the elastic loop gasket. This is done by pressing the foil against the end or edges of the container flange and stretching and slipping the elastic loop gasket over the foil and flange and then releasing the elastic loop gasket. The elastic material of the loop closure can be made of a silicone rubber of low heat conductivity that enables the container to be placed in a refrigerator or an oven at over 300 degrees F. yet be removed with bare hands. The elastic loop gaskets have tabs and webs to assist attachment and removal from containers. The four sides of the square or rectangular elastic loop gasket extend inwardly at the meeting corners to form webs that stabilize the corners and facilitate easy removal and attachment of the elastic loop gasket to a container. This is especially useful when used with one or more corner tabs. The container with a foil held in place can be inverted upside down without leakage of a liquid held within the container. The gasket acts as a noise suppressor and the ridge acts as a frictional resistance to prevent implements from slipping into the container when open and not covered.

DESCRIPTION OF THE PREFERRED EMBODIMENT

Figure 1:
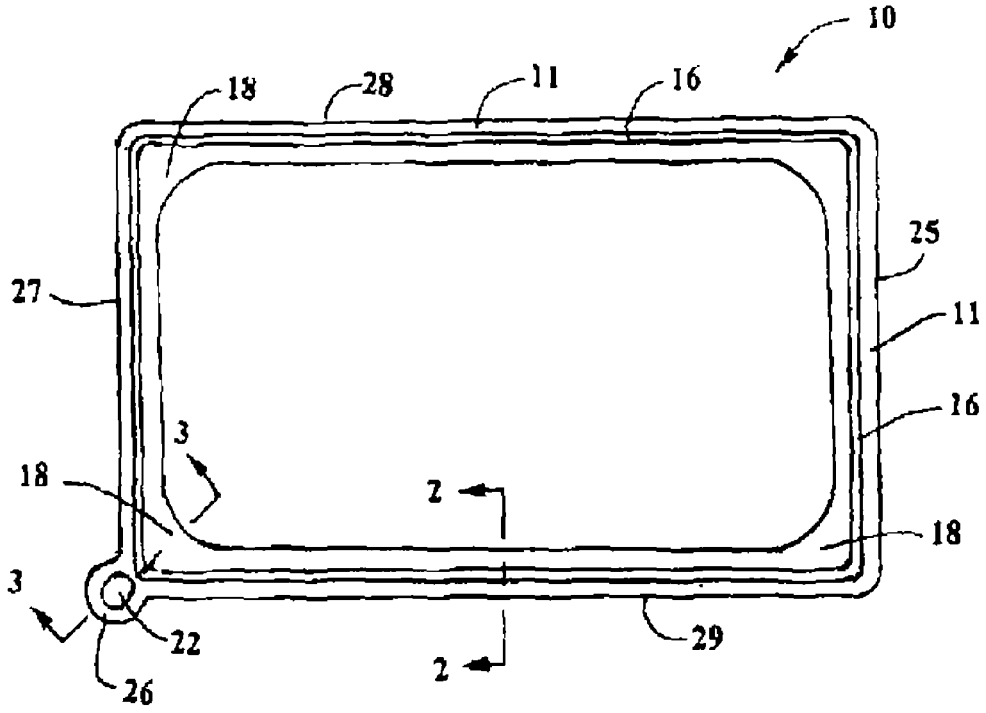
FIG. 1 is a top view of a rectangular elastic loop gasket.

The preferred embodiment is a modification of the elastic loop closure holder of U.S. Pat. No. 5,964,368, issued Oct. 12, 1999. As seen in FIG. 1, the multipurpose elastic loop closure gasket 10, as shown in FIG. 1, has a top elastic leg 11 extending from the elastic loop base 12. A raised ridge 16 extends upward from the top of the elastic leg 11. The corners of the elastic loop extend inward to form upper corner webs 18 with one corner shown extending outward to form a tab 26 having a tab recessed finger-hold and indicia area 22. The elastic loop 10 can be molded or pressed from a rubber or other elastic material having a low heat conductivity with a resilient silicone the material of choice for maximum multipurpose use. The main concern is that the elastic loop be capable of stretching a minimum of 2% of its length and preferably 10% so that it can be stretched and placed over the flange of a container and then be capable of returning to its original length and shape when released. The elastic gasket should be temperature resistant and capable of being placed in a freezer and/or oven and inserted and removed with bare hands using the elastic gasket as a handhold whether the container is coming from the freezer or oven eliminating the need for gloves or other hand protection.

Figure 3:
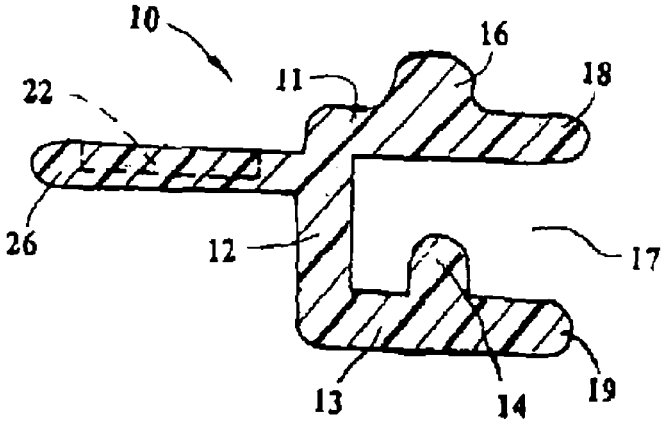
FIG. 3 is a detailed vertical sectional view taken along the lines 3-3 of FIG. 1.

As can be seen in FIGS. 1 and 3, a tab 26 is shown at one corner of the elastic loop gasket. The tab extends outwardly in a limited area from the base 12 in a plane that is essentially that of the elastic loop legs 11,13 or parallel to them. One or more tabs 26 can be provided as gripping means 22 for stretching the elastic loop to remove it from or to apply it over and onto the pan flange 3. An indicia area 22 on the tab provides an area for placing a label on or an area for writing information on, such as for identifying the contents of the pan and/or the date the contents were placed in the pan. The elastic loop and/or the tab can alternatively or concurrently be color coded as a means of quickly identifying the type of material or food placed in the pan. For example a red gasket could identify a meat, yellow a poultry, blue a cooked food, green a fish, etc., to prevent cross-contamination and for easy identification. As an alternative, the elastic loop and/or tab can be color coded as a means of quickly identifying the type of material it is made of and thus the temperature that it can be used at.

By molding or forming the legs 11, 13 of the elastic loop with a minimum clearance between the legs 11, 13 and the bead 14, the spreading caused by placement of the pan flange 3 between the legs results in an inward force exerted on the bead 14 that presses any foil placed over the container flange onto the flange upper and lower surfaces. The legs can be molded parallel or so that they taper and touch each other at their outer extent for an added inward force when placed over a container flange.

Figure 2:
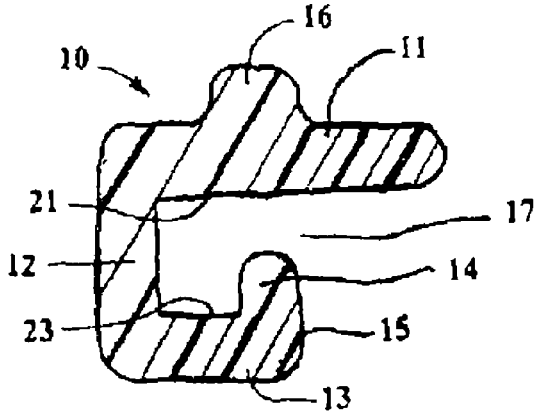
FIG. 2 is a detailed vertical sectional view taken along the lines 2-2 of FIG. 1.

FIG. 2 is a sectional view taken along section lines 2-2 of FIG. 1. The elastic loop gasket base 12 shows the top elastic leg 11 with the upper outer raised ridge 16. The elastic lower leg 13 extends out from the gasket loop base 12 with a lower leg inner bead 14 extending upward from the lower leg 13 end 15.

FIG. 3 is a sectional view taken along section lines 3-3 of FIG. 1. The elastic loop gasket base 12 additionally shows the upper corner web 18 of FIG. 1 extending inward further than the upper or top elastic leg 11 and also shows the lower corner web 19 extending inward further than the lower elastic leg 13. The tab 26 is shown extending outward from a corner of the base 12. The tab 26 is shown having the recessed finger hold and indicia area 22.

FIGS. 2 and 3 show a pan flange receiving recess 17 facing inwardly. The recess is formed between the lower elastic gasket leg 13 inner surface 23 and the upper elastic gasket leg 11 inner surface 21. The lower elastic gasket leg 13 and the upper elastic gasket leg 11 extend inwardly from the elastic gasket base 12. The recess has a depth essentially that of the container flange width. The lower gasket leg 13 is provided with a bead 14 shown at or near the terminal end of the lower leg. The bead 14 and raised ridge 16 are molded or formed so as to be essentially over and under each other so that the bead 14 can fit within a container flange curvature and the raised ridge 16 can fit within a lid flange or outer end curvature in the same manner that the lid flange curvature fits over the container flange curvature when the gasket is not used in between them.

Figure 4:
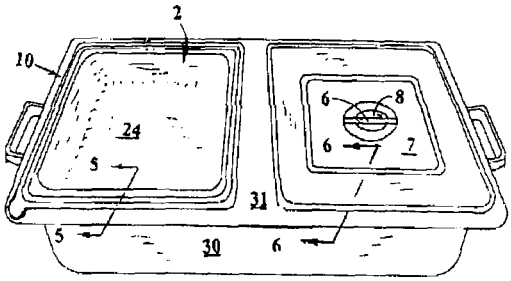
FIG. 4 is a perspective view of a steam chest supporting one open container with an elastic loop gasket assembled on it and a second container with a lid over the elastic loop gasket.

FIG. 4 shows the elastic loop gasket 10 positioned over a container 2 on a support 30 on one side and a similar container having a lid 7 placed over the gasket on the other side.

To attach the multipurpose elastic loop gasket, the elastic gasket is stretched and laterally inserted over a first end 25 of the pan flange. It is then stretched from the tab 26 end 27 of the gasket. The gasket is laterally placed over the flange at the first side 28 and second side 29 and then over the flange 3 remote second gasket end 27. The attachment is completed by pulling on the tab 26 to stretch the gasket tab corner over the last pan corner next to the tab 26. It has been discovered that the addition and use of the upper corner webs 18 facilitates and makes the gasket stable and much easier to insert the gasket onto the pan flange. The addition of both upper corner webs 18 and lower corner webs 19 makes insertion of the pan flange 3 still more stable and easier to attach than when only upper webs are used. The webs' size and extent can be varied as desired and needed for easiest use.

Figure 5:
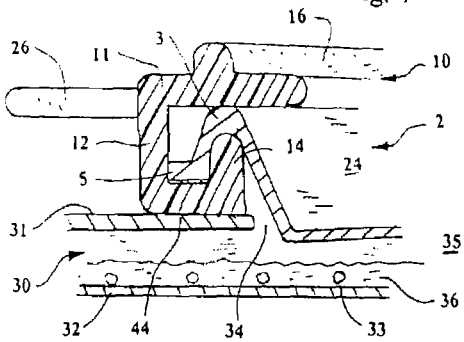
FIG. 5 is a fragmented vertical sectional view through a container with the elastic loop gasket attached along the line 5-5 of FIG. 4.

FIG. 5 shows the elastic loop gasket 10 positioned on a container 2 taken along the lines 5-5 of FIG. 4. The curved flange 3 of the container is within the elongated loop gasket recess 17 with the lower bead 14 fitting within the lower curved recess formed in the container curved flange 3 to form a seal between the elastic loop gasket and the container around the container flange. The lower leg 13 of the elastic loop gasket is shown in contact with a steam chest 30 upper surface 31 to seal 44 the container onto the steam chest and preclude steam or vapor from passing through the opening 34 in the steam chest.

Figure 6:
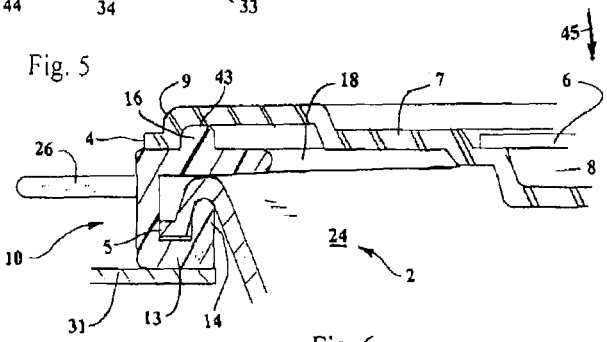
FIG. 6 is a fragmented vertical sectional view through a container and container lid with the elastic loop gasket in assembled position along the lines 6-6 of FIG. 4.

FIG. 6 shows the elastic loop gasket 10 positioned over a container 2 flange as in FIG. 5 along the line 6-6 of FIG. 4 with a lid or cover 7 placed over the container 2 in contact 43 with the elastic loop gasket. The raised ridge 16 fits within the lid extremity end 4 curvature 9 to seal the lid to the elastic loop gasket around its entire loop. In this manner there is a seal between the lid and gasket and between the gasket and the container and between the container and the steam chest. This results in efficiency by reducing heat losses and preventing cooling of the container contents and drying out of its contents.

Figure 7:
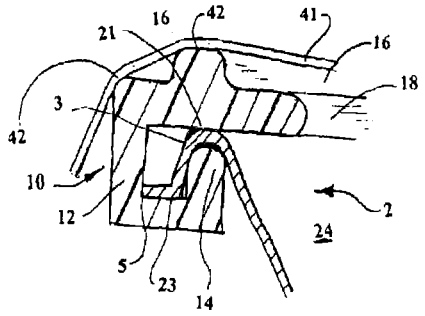
FIG. 7 is a fragmented vertical sectional view through a container with the elastic loop gasket assembled and having a foil covering the container opening.

FIG. 7 shows the multipurpose elastic loop gasket 10 positioned on a container 2 flange 3 with a foil 41 extending over the multipurpose elastic loop gasket 10 and in contact 42 with it at the raised ridge 16 and at the elastic loop gasket base 12. The elastic loop gasket can be placed over the container flanges without a foil and left in that position. When it is desired to cover the open top of the container. The foil 41 is placed over the container open top and flanges. This procedure can be used repeatedly for providing a temporary closure for the container. The closure foils can be any resilient material such as paper or aluminum but a transparent plastic cling, temperature resistant foil or wrap is preferred. The material used is chosen for the environment and temperature(s) it is to be used in. The preferred material is one that is air tight and moisture proof and that is capable of functioning under freezer and/or oven conditions.

Figure 8:
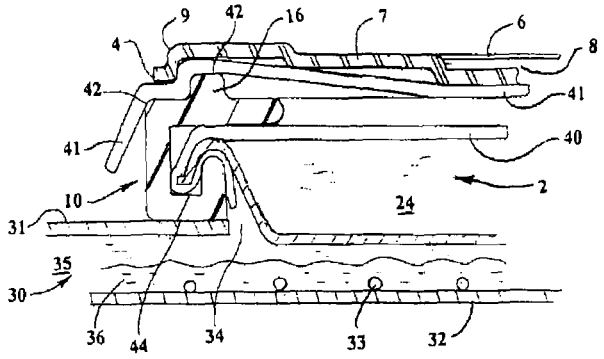
FIG. 8 is a fragmented vertical sectional view through a container and container lid with the elastic loop gasket assembled and having two foils covering the container opening positioned on a steam chest.

FIG. 8 shows the multipurpose elastic loop gasket 10 positioned on a container 2 flange 3. The device is used by selecting an elastic loop gasket that has a peripheral length that is essentially the same length or slightly shorter than that of the container flange and placing the foil 40 over the open top of the container so that the foil extends beyond the container flanges 3 on all sides. The elastic loop gasket 10 is then stretched and placed over the foil and over the flanges on essentially three sides. The elastic loop is then pulled so that it is over the foil and flange at the fourth side or corner and released to clamp the foil in place over the entire flange to cover the container open top. This procedure alone can be used repeatedly for providing a lengthy or temporary closure for the container. It has been found that, with the foil in place, a liquid or mixed solid-liquid content in the pan, the container can be flipped upside down and that the liquid will not escape from the container.

In FIG. 8 a first foil 40 is held in place over the pan 2 with the foil pressed against the container flange end 5 by the elastic loop gasket base 12 and against the container flange 3 upper surface by the upper leg 11 inner surface 21 and container flange lower surface by the lower bead 14 of the elastic gasket leg 13. This makes a firm arrangement holding the elastic loop gasket and container firmly together. At the same time a second foil 41 is held in place over the pan opening as in FIG. 7. With this arrangement, a double foil closure seal is provided for the pan contents and the air space between the foils provides insulation. With one first foil 40 secured under the elastic loop 10 and a second foil 41 above the elastic loop gasket, as in FIG. 7, a container lid or cover 7 can be positioned over the container 10 in contact with the second foil 41 over the raised ridge 16. The container 2 main body 24 is shown inserted through a steam chest 30 opening 34 with the outer surface of the lower elastic leg 13 elastic loop gasket in contact with a steam chest 30 upper surface 31, forming a seal between the container and steam chest. The steam chest 30 forms an enclosure 35 having a base 32 containing steam pipes 33 submerged in water 36.

Figure 9:
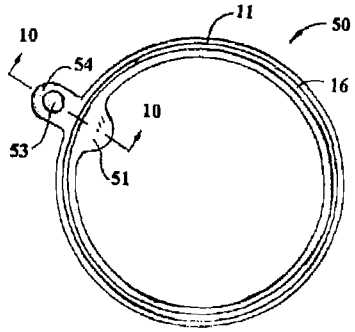
FIG. 9 is a top view of a circular elastic loop gasket.
Figure 10:
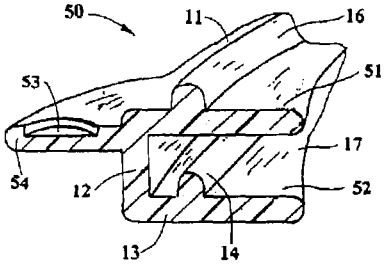
FIG. 10 is a detailed vertical sectional view taken along the lines 10-10 of FIG. 9.

FIGS. 9 and 10 show the elastic gasket in the shape of a circle 50 for use on circular flanged containers. The elastic gasket has essentially the same cross-sectional shape as for square or rectangular elastic gaskets except that the webs 18,19 and tab 26 of the right angle corners have the webs 51, 52 and tab 54 positioned adjacent each other along the periphery of the circular elastic gasket. These structures, including the indicia area 53, perform essentially the same function as in the square and rectangular elastic gaskets.

When the gasket 10 is in place on the container 2 and the top of the container is open for removal of food or other content as shown in FIG. 4. A spoon or other implement can be quietly placed in the container and with a handle against the raised ridge 16, the spoon or other implement will not slide into the container due to the friction between the raised ridge and the spoon or other implement, due to friction between them.

The multipurpose elastic loop gasket 10 is made from an elastic material that has a very low heat conductivity and a high tolerance for heat and high coefficient of friction. The preferred material is a silicone-based rubber. This enables the pan having the elastic gasket to be placed within and removed from a freezer or oven at 300 degrees F. or more using bare hands in contact with the gasket. Due to the elasticity of the gasket, the pan 2 can be placed in the opening 34 in the steam chest to seal the pan within the steam chest by forming contact between the elastic loop gasket lower leg 13 bottom surface and the steam chest top surface 31. This prevents escape of steam from the chest and conserves energy. In a like manner the lid 7 can be sealed onto the container when placed over the gasket raised ridge 16 as shown at 43 in FIG. 6.

By pressing 45 on the lid cover handle 6 area at the recess 8 area, air can be expelled from the area between the pan 2 and the lid or cover 7. On release a slight vacuum is formed that uses atmospheric pressure to press the lid onto the gasket at 43. This prevents leakage from the container conserving energy and preventing transfer of fluid between the container 2 and surrounding environment and dry-out of the container contents.

While the elastic loop gasket dimensions can be varied to accommodate the specific container thickness and dimensions, for a typical food service employing a 10×12 inch pan an elastic loop gasket can, for example, be plus or minus 1/16 inch of the following dimensions. The elastic gasket thickness of the upper leg base, lower leg, raised ridge and lower bead can all be about 1/18 inch with the outer lower leg extending in from the elastic loop gasket leg base 12 about 1/4 inch and the upper leg about 5/8 inch and the webs can extend inward about 1 inch from the inner web corners. The tab can extend out about 1/2 to 3/4 inch.

The food industry is an example of where the invention can be used. With a stainless steel pan and the appropriate plastic foils or wraps, used with the elastic loop gasket snapped around the entire perimeter of the pan, the covered pan can be placed in an oven at 300 degrees F. or in an ALTOSHAM™ or steam table for extended periods of time without food drying out, or it can be placed in a freezer or refrigerator for extended periods of storage.

The container and elastic loop gasket are securely confined together both vertically and horizontally by having the container flange end 5 abut the elastic loop gasket base 12 and curved flange 3 abut both sides of the elevated lower leg inner bead 14 in the horizontal direction and the container upper curved flange 3 abut the elastic loop gasket upper leg 11 inner surface 21 and the lower outer extent of the flange abut the upper surface of the lower leg 23 as the lower side of the curved flange 3 abuts the upper end of the bead 14. With this confinement of the elastic loop gasket 10 and container flange 3,5 extending around the entire periphery or extent of the elastic loop gasket and container flange, they are securely but removably attached together against accidental or incidental removal.

In a similar manner the lid 7 end 4 curvature 9 is confined against lateral movement by the confinement of the lid against the raised ridge 16.

Advantages of the elastic loop gasket include:

Firm attachment of an elastic loop gasket to a container due to elasticity and inner engagement of the elastic loop gasket and container flange.

Sealing of a container to a support or steam chest preventing steam and vapor escape.

Sealing of a lid to a container.

Sealing between a foil and container.

Sealing between a foil and gasket.

Ability to bare hand insert and remove a container from a freezer or an oven due to the low heat conductivity of the elastic loop gasket even if the container itself is very cold or hot.

Quiet insertion and removal of a metal container to a support or steam chest.

Quiet application and removal of a metal lid to a metal container.

Quiet placement of a metal implement when not in use against an elastic gasket raised ridge.

Temporary covering of a container with a foil due to the adherence or friction between a foil and the gasket.

Prolonged covering of a container with a foil due to the ability to place the foil over the container and between a gasket and container flange.

Insulation formed between two foils over a container opening.

Open container implement slide prevention and/or retention by contact with a raised ridge of an elastic loop gasket.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

The invention claimed is:

1. A multipurpose elastic loop gasket including:

said elastic loop gasket formed by a base with an upper leg and a lower leg extending from said base;

said elastic loop gasket upper leg and said elastic loop lower leg are essentially parallel to each other and form an inwardly opening elongated narrow recess there-in-between so as to be capable of receiving a horizontally outwardly extending flange of a container;

a raised ridge extending upwardly from said elastic loop gasket upper leg along the extent of said elastic loop gasket for positioning a container lid or foil;

a bead extending upwardly from said elastic loop gasket lower leg along the extent of said elastic loop gasket for positioning and retaining the flange of a container;

said elastic loop gasket being stretchable by more than 2% of its unstretched length with the ability to return to its unstretched length, so as to be able to elastically deform and be held in place over a container flange;

said elastic loop gasket has four sides that intersect each other at right angles;

corner webs are formed inwardly at the areas said upper legs intersect to rigidity the corners and provide easy insertion and removal of said elastic loop gasket.

2. A multipurpose elastic loop gasket as in claim 1 wherein:

corner webs are formed inwardly at the area said lower legs intersect to rigidify the corners and provide easy insertion and removal of said elastic loop gasket.

3. A multipurpose elastic loop gasket including:

said elastic loop gasket formed by a base with an upper leg and a lower leg extending from said base;

said elastic loop gasket upper leg and said elastic loop lower leg are essentially parallel to each other and form an inwardly opening elongated narrow recess there-in-between so as to be capable of receiving a horizontally outwardly extending flange of a container;

a raised ridge extending upwardly from said elastic loop gasket upper leg along the extent of said elastic loop gasket for positioning a container lid or foil;

a bead extending upwardly from said elastic loop gasket lower leg along the extent of said elastic loop gasket for positioning and retaining the flange of a container, said elastic loop gasket being stretchable by more than 2% of its unstretched length with the ability to return to its unstretched length, so as to be able to elastically deform and be held in place over a container flange;

said elastic loop gasket base extends outwardly in a limited area to form a tab for stretching said elastic loop gasket;

said tab is provided with a recessed area for finger gripping and for receiving indicia for indicating dates and/or contents;

said elastic loop gasket has four sides that intersect each other at right angles;

corner webs are formed inwardly at the areas said lower legs intersect to rigidify the corners and provide easy insertion and removal of said elastic loop gasket.

4. A detachable multipurpose elastic loop gasket in combination with a container wherein:

said container has an open upper end with a flange extending outwardly around the periphery of said container open upper end;

said elastic loop gasket has an upper leg and a lower leg extending inwardly essentially parallel to each other from a base forming an elongated recess facing inwardly;

said elongated recess is essentially the same width as the thickness of said container flange;

said elastic loop gasket is endless with said base peripheral length being essentially the same as that of said container flange outer peripheral length;

said elastic loop gasket has enough elasticity to be stretched over said container flange and to return to its unstretched length so as to be secured and held in place around said container open end;

a raised integral ridge extends upwardly from said elastic loop gasket upper leg around the extent of said elastic loop gasket for securing a container lid or foil over said container open end.

5. A detachable multipurpose elastic loop gasket in combination with a container as in claim 4 wherein:

a bead extends upwardly from said elastic loop gasket lower leg for securing said elastic loop gasket to said container flange.

6. A detachable multipurpose elastic loop gasket in combination with a container as in claim 5 wherein:

said container flange has a curvature and outer end;

said bead extends upwardly from said elastic loop gasket lower leg innermost extent for entering into said curvature in said container flange for securing said container and elastic loop gasket together.

7. A detachable multipurpose elastic loop gasket in combination with a container as in claim 5 wherein:

said elastic loop gasket includes a tab extending outwardly for stretching said elastic loop;

said tab is provided with an indicia receiving area for indicating a date and/or contents.

8. A detachable multipurpose elastic loop gasket in combination with a container as in claim 4 wherein:

said elastic loop gasket has four sides that intersect each other at right angles;

corner webs are formed inwardly at the areas said upper legs intersect to rigidify the corners and provide easy insertion and removal of said multipurpose elastic loop gasket;

corner webs are formed inwardly at the areas said lower legs intersect to rigidify the corners and provide easy insertion and removal of said multipurpose elastic loop gasket.

9. A detachable multipurpose elastic loop gasket in combination with a container as in claim 5 wherein:

said container flange has an end with an inward curvature at said end;

said elastic loop gasket bead extending upwardly is essentially the height of said container flange end curvature.

10. A detachable multipurpose elastic loop gasket in combination with a container as in claim 5 wherein:

said container has an outer flange end;

said container is provided with an outer curve along said container outer flange end;

said elastic loop gasket raised bead is integral and mates with said container outer flange end curve to position and seal said container to said elastic loop gasket while said elastic loop gasket base engages said container outer flange end.

11. A detachable multipurpose elastic loop gasket in combination with a container as in claim 5 wherein:

said container is provided with a container lid;

said container lid has a flange with an outer end curvature;

said elastic loop gasket raised integral ridge mates with said container lid flange outer curvature to position and seal said container lid onto said elastic loop gasket.

12. A detachable multipurpose elastic loop gasket in combination with a container as in claim 9 wherein:

said container is provided with a lid;

said container lid has an outer flange curved end;

a foil is placed over said elastic loop gasket raised ridge;

said lid is placed over said foil on said elastic loop gasket raised ridge with said lid outer flange curved end pressing said foil onto said raised ridge.

13. A detachable multipurpose elastic loop gasket in combination with a container as in claim 9 wherein:

a foil extends over said container open end;

said foil extends over said container flange and under said container flange under said elastic loop upper leg and over said lower bead on said elastic loop lower leg to seal said foil over said container open end.

14. A detachable multipurpose elastic loop gasket in combination with a container as in claim 12 wherein:

said foil over said elastic loop gasket raised ridge is a second foil;

a first foil extends over said container open end;

said first foil extends over said container flange under said elastic loop upper leg and extends under said container flange over said bead on said elastic loop lower leg to seal said first foil over said container open end.

* * * * *